US010077520B2

(12) United States Patent
Lee et al.

(10) Patent No.: US 10,077,520 B2
(45) Date of Patent: Sep. 18, 2018

(54) WASHING MACHINE WITH PULSATOR AND PLANETARY GEAR DEVICE

(71) Applicant: LG ELECTRONICS INC., Seoul (KR)

(72) Inventors: Kyubum Lee, Seoul (KR); Youngjong Kim, Seoul (KR); Sangjun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 508 days.

(21) Appl. No.: 14/057,524

(22) Filed: Oct. 18, 2013

(65) Prior Publication Data

US 2014/0109627 A1 Apr. 24, 2014

(30) Foreign Application Priority Data

Oct. 23, 2012 (KR) ..... 10-2012-0117971

(51) Int. Cl.
*D06F 17/08* (2006.01)
*D06F 17/10* (2006.01)
*D06F 37/40* (2006.01)

(52) U.S. Cl.
CPC ..... *D06F 17/08* (2013.01); *D06F 17/10* (2013.01); *D06F 37/40* (2013.01)

(58) Field of Classification Search
CPC ..... D06F 17/08; D06F 17/10; D06F 37/40
USPC ..... 38/23.6, 23.7; 68/23.6, 23.7
See application file for complete search history.

(56) References Cited

U.S. PATENT DOCUMENTS 5,661,990 A 9/1997 Chong
6,070,439 A * 6/2000 Jung ..... D06F 17/10 68/134
7,377,870 B2 * 5/2008 Matsushita ..... F16H 57/0482 475/159

(Continued)

FOREIGN PATENT DOCUMENTS

CN 1137078 A 12/1996
CN 201027257 Y 2/2008
CN 101962903 A 2/2011

(Continued)

OTHER PUBLICATIONS

Jang et al. KR1020030042621 (Date Feb. 2003, D06F17/10)—translation.*

*Primary Examiner* — Rita P Adhlakha
(74) *Attorney, Agent, or Firm* — Dentons US LLP

(57) ABSTRACT

Disclosed is a washing machine including an inner tub in which fabrics are accommodated, a fixing hub installed to the inner tub, a rotating shaft configured to penetrate the inner tub and the fixing hub, a sun gear installed to the rotating shaft and having a lower gear portion and an upper pulsator coupling portion, an inner pulsator coupled to the pulsator coupling portion, a plurality of planetary gears engaged with the gear portion and rotatably arranged on the fixing hub, a ring gear having an inner circumferential surface engaged with the planetary gears, a gear box coupled to the ring gear, and an outer pulsator coupled to the gear box, the outer pulsator being larger than the inner pulsator. As the inner pulsator and outer pulsator are rotated at different rates of rotation, complex 3D water stream may be created in the inner tub, resulting in enhanced washing ability.

12 Claims, 6 Drawing Sheets

(56) References Cited

U.S. PATENT DOCUMENTS

2010/0175434 A1* 7/2010 Park ..... D06F 17/08
68/147

FOREIGN PATENT DOCUMENTS

| | | | |
|---|---|---|---|
| CN | 202279943 | U | 6/2012 |
| JP | 2000-157775 | A | 6/2000 |
| JP | 2010-000135 | A | 1/2010 |
| KR | 10-1998-0068657 | A | 10/1998 |
| KR | 20-0150796 | Y1 | 4/1999 |
| KR | 10-2003-0042621 | A | 6/2003 |

* cited by examiner

WASHING MACHINE WITH PULSATOR AND PLANETARY GEAR DEVICE

CROSS-REFERENCE TO RELATED APPLICATION

This application claims the priority benefit of Korean Patent Application No. 10-2012-0117971 filed on Oct. 23, 2012, in the Korean Intellectual Property Office, the disclosure of which is incorporated herein by reference in its entirety.

BACKGROUND OF THE INVENTION

1. Field of the Invention

The present invention relates to a washing machine, and more particularly to a washing machine in which a pulsator to create a rotating water stream is rotatably installed within an inner tub in which fabrics are accommodated.

2. Description of the Related Art

In general, a washing machine is a machine that provides mechanical action using electricity to remove contaminants and the like adhered to clothing, bedding, and the like (hereinafter referred to as fabrics). The contaminants adhered to fabrics are separated from the fabrics via chemical reaction of detergent contained in wash water. The washing machine requires a long time to remove the contaminants adhered to fabrics via reaction of detergent alone. When applying mechanical action, such as friction, vibration, or the like, by generating a water stream, easier and more rapid separation of the contaminants may be accomplished.

The washing machine may be classified into a dual tub type washing machine, a pulsator type washing machine, and a drum type washing machine.

In the dual tub type washing machine, a washing tub for implementation of washing and rinsing and a dehydration tub for implementation of dehydration are arranged respectively in left and right regions within a casing. The washing tub and the dehydration tub are driven independently of each other using a drive motor, such that laundry is first subjected to washing and rinsing within the washing tub, and subsequently moved to the dehydration tub to thereby be subjected to dehydration.

In the pulsator type washing machine, an inner tub in which laundry is accommodated is rotatably installed within an outer tub in which water is accommodated. A pulsator to create a rotating water stream is rotatably installed at an inner bottom surface of the inner tub. Both the outer tub and the inner tub have top openings for introduction and removal of fabrics from the upper side of the washing machine. With this configuration, fabrics are washed by a rotating water stream that is generated as the pulsator is rotated within the inner tub.

In the drum type washing machine, a drum in which laundry is accommodated is rotatably placed within a tub in which water is accommodated. Both the drum and the tub have front center openings for introduction and removal of laundry from the front side of the washing machine. The drum is connected to a horizontal rotating shaft of a motor that is secured to the tub, enabling washing of laundry.

SUMMARY OF THE INVENTION

It is an object of the present invention to provide a washing machine in which an inner pulsator and an outer pulsator are rotated at different rates of rotation.

In accordance with one aspect of the present invention, the above and other objects can be accomplished by the provision of a washing machine including an inner tub in which fabrics are accommodated, a fixing hub installed to the inner tub, a rotating shaft configured to penetrate the inner tub and the fixing hub, a sun gear installed to the rotating shaft, the sun gear having a lower gear portion and an upper pulsator coupling portion, an inner pulsator coupled to the pulsator coupling portion, a plurality of planetary gears engaged with the gear portion, the planetary gears being rotatably arranged on the fixing hub, a ring gear, an inner circumferential surface of which is engaged with the plurality of planetary gears, a gear box coupled to the ring gear, and an outer pulsator coupled to the gear box, the size of the outer pulsator is greater than the size of the inner pulsator.

The rate of rotation of the outer pulsator may be less than the rate of rotation of the inner pulsator.

A support shaft configured to rotatably support a corresponding one of the planetary gears may be installed to the fixing hub.

The washing machine may further include a planetary gear holder coupled to an upper portion of the support shaft.

An inner circumferential surface of the planetary gear and an outer circumferential surface of the support shaft may be immersed with a lubricant.

The gear box may have a sun gear through-hole, through which the sun gear penetrates, and an upper bearing may be located in the sun gear through-hole to assist the sun gear in being rotatably supported by the gear box.

The fixing hub may have a sun gear through-hole, through which the sun gear penetrates, and a lower bearing may be located in the sun gear through-hole to assist the sun gear in being rotatably supported by the fixing hub.

The washing machine may further include a lower cover coupled to a lower portion of the gear box.

The washing machine may further include an outer bearing located between the lower cover and the fixing hub to assist the lower cover in being rotatably supported by the fixing hub.

The inner pulsator may include at least one upwardly protruding inner ridge and may be located above the outer pulsator.

The outer pulsator may include a sun gear penetrating portion facing a lower surface of the inner pulsator, through which the sun gear penetrates, and a water stream generating portion from which at least one outer ridge protrudes upward.

The sun gear penetrating portion may be centrally provided with a hub portion having a bottom opening, and the gear box may be inserted into the hub portion to thereby be coupled to the outer pulsator.

The outer ridge may be spaced apart from the inner ridge.

A ring-shaped rib may protrude from the outer pulsator to surround a rim of the inner pulsator.

The fixing hub may be installed on an upper surface of a bottom plate of the inner tub.

In accordance with another aspect of the present invention, there is provided a washing machine including an inner tub in which fabrics are accommodated, an outer pulsator rotatably located in a lower region of the inner tub, an inner pulsator rotatably located above the outer pulsator, and a planetary gear device installed to the inner tub, the planetary gear device being connected to the inner pulsator and the outer pulsator to rotate the inner pulsator and the outer pulsator at different rates of rotation.

The outer pulsator may include a hub portion, into which at least a portion of the planetary gear device is inserted.

The planetary gear device may include a sun gear configured to penetrate the outer pulsator.

The inner pulsator may include at least one upwardly protruding inner ridge, and the outer pulsator may include a sun gear penetrating portion facing a lower surface of the inner pulsator, through which the sun gear penetrates, and a water stream generating portion from which at least one outer ridge protrudes upward.

The inner ridge may extend by a long length in a radial direction of the inner pulsator, and the outer ridge may extend by a long length in a circumferential direction of the outer pulsator.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
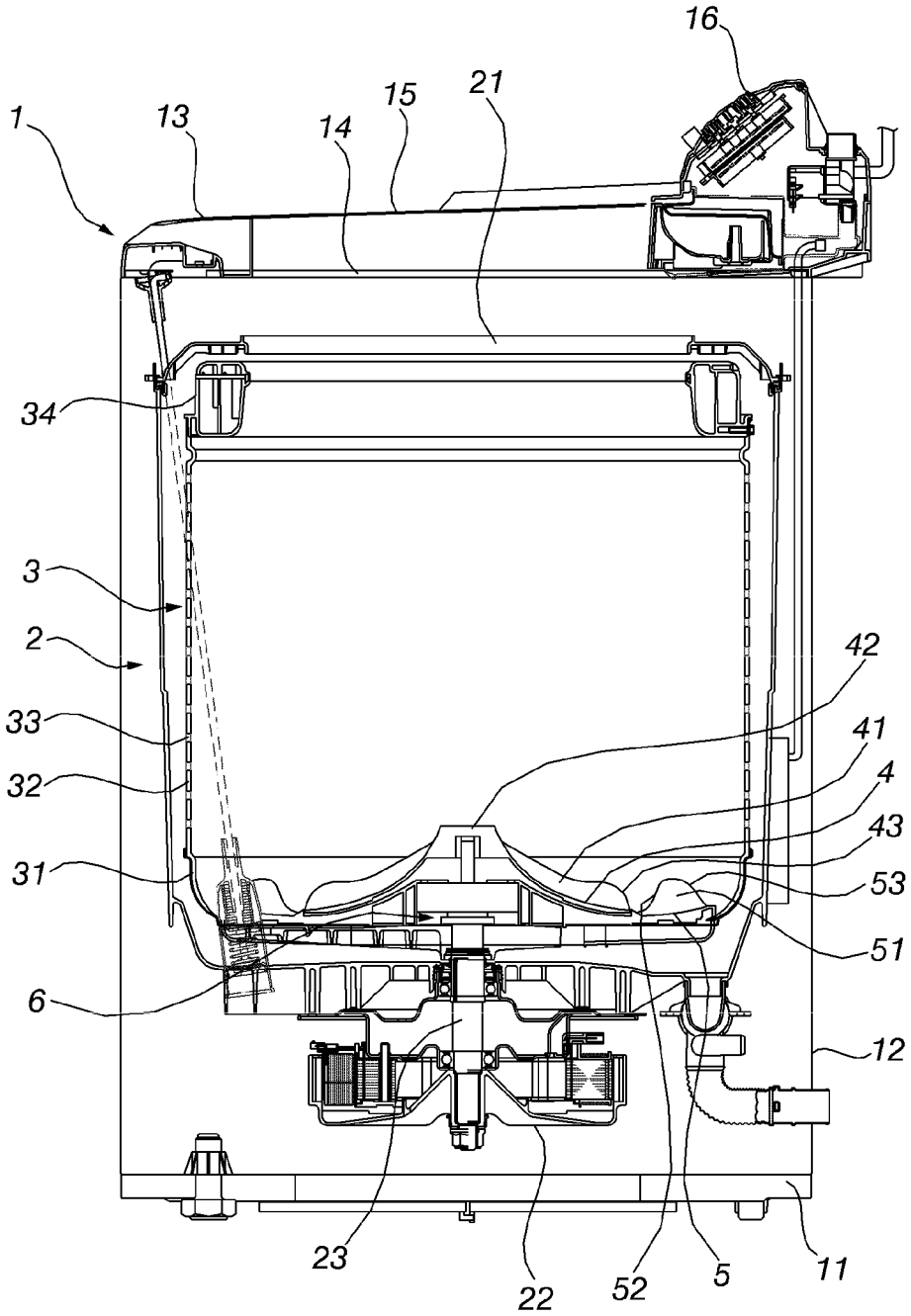
FIG. 1 is a side view showing the interior of a washing machine according to an embodiment of the present invention.
Figure 2:
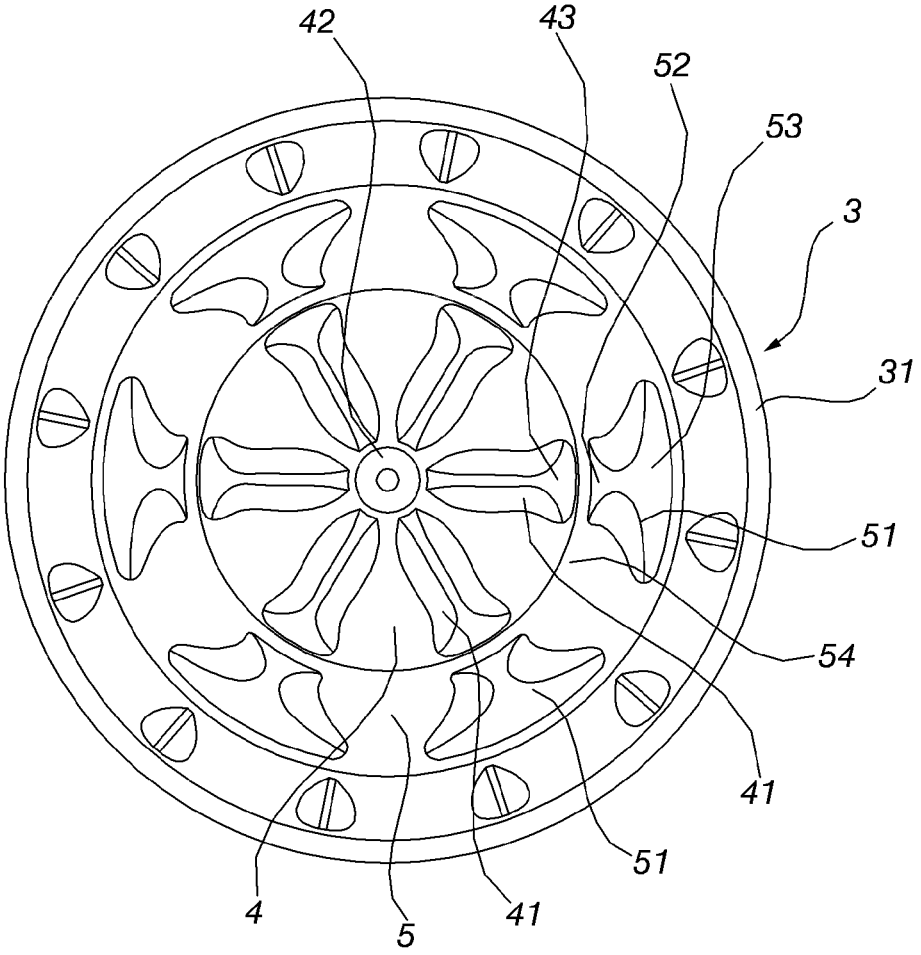
FIG. 2 is a plan view showing the interior of a washing machine according to an embodiment of the present invention.

FIG. 1 is a side view showing the interior of a washing machine according to an embodiment of the present invention, and FIG. 2 is a plan view showing the interior of a washing machine according to an embodiment of the present invention.

The washing machine exemplarily shown in FIG. 1 may include a casing 1, an outer tub 2, an inner tub 3, an inner pulsator 4, an outer pulsator 5, and a planetary gear device 6.

The casing 1 may define the external appearance of the washing machine. The casing 1 may include a base 11, a body 12 placed on top of the base 11 to define the external appearance of a peripheral wall of the washing machine, and a top plate 13 installed on top of the body 12. The top plate 13 may have a fabric introduction/removal opening 14 for introduction and removal of fabrics. A lid 15 may be coupled to the top plate 13 to open or close the fabric introduction/removal opening 14. A control panel 16 for manipulation of the washing machine may be installed to the casing 1. The control panel 16 may be located at a front portion of the top plate 13, or may be located at a rear portion of the top plate 13.

The outer tub 2 may be placed within the casing 1. Wash water for washing of fabrics may be accommodated in the outer tub 2. The outer tub 2 may have a top opening 21. Fabrics may be introduced into or removed from the inner tub 3 through the opening 21 of the outer tub 2. The outer tub 2 may be installed in a shock absorbing fashion within the casing 1 using dampers or hangers. The outer tub 2 may be equipped with a motor 22 that serves as a drive source to generate drive power required to rotate the inner pulsator 4 and the outer pulsator 5. The motor 22 may also be used to rotate the inner tub 3, in addition to the inner pulsator 4 and the outer pulsator 5. The washing machine may include a rotating shaft 23 to transmit rotation power generated by the motor 22 to the planetary gear device 6.

Fabrics may be accommodated in the inner tub 3. The inner tub 3 may be located within the casing 1. The inner tub 3 may have a smaller size than the outer tub 2 so as to be placed within the outer tub 2. The outer tub 2 may function as a tub in which wash water is accommodated, and the inner tub 3 may function as a tub in which fabrics are washed by wash water. The inner tub 3 may include a tub base 31 having a top opening and an inner tub body 32 coupled to an upper end of the inner tub base 31. The inner tub body 32 may take the form of a hollow cylinder. The inner tub body 32 may have water holes 33 for passage of wash water. A balancer 34 may be installed to an upper end of the inner tub body 32.

The inner pulsator 4 may be rotatably located at an inner bottom surface of the inner tub 3, and serve to create a rotating wash water stream via rotation thereof. The inner pulsator 4 may be rotated along with the outer pulsator 5. The inner pulsator 4 may be located above the outer pulsator 5. That is, the inner pulsator 4 may serve as an upper pulsator located above the outer pulsator 5, and the outer pulsator 5 may serve as a lower pulsator located below the inner pulsator 4. The inner pulsator 4 may have at least one inner ridge 41. The inner ridge 41 may protrude upward from the inner pulsator 4. The inner pulsator 41 may be centrally provided with a planetary gear device connecting portion 42 to which the planetary gear device 6 is connected. The inner ridge 41 serves to induce a rotating water stream around the inner pulsator 4. To this end, the inner ridge 41 may extend by a long length in a radial direction of the inner pulsator 4. More specifically, the inner ridge 41 may extend by a long length from the planetary gear device connecting portion 42 to the rim of the inner pulsator 4. As shown, a plurality of inner ridges 41 may be arranged in a radial direction. Each inner ridge 41 may be connected at an inner end thereof to the planetary gear device connecting portion 42. The inner ridge 41 may have an outer end surface 43 oriented to face an outer ridge 51 of the outer pulsator 5 that will be described hereinafter. More specifically, the outer end surface 43 of the inner ridge 41 may face an inner end surface 52 of the outer ridge 51 that will be described hereinafter. The outer end surface 43 of the inner ridge 41 may have a size equal to or less than the size of the inner end surface 52 of the outer ridge 51.

The outer pulsator 5 may be rotatably located at the inner bottom surface of the inner tub 3, and serve to create a rotating wash water stream via rotation thereof. The outer pulsator 5 may be rotated along with the inner pulsator 4. Here, the inner pulsator 4 and the outer pulsator 5 may be rotated at different rates of rotation. The size of the outer pulsator 5 may be greater than the size of the inner pulsator 4. The outer pulsator 5 may have at least one outer ridge 51. The outer ridge 51 may protrude upward from the outer pulsator 5. The outer ridge 51 serves to induce a rotating water stream around the outer pulsator 5. The outer ridge 51 may be located between the inner pulsator 4 and an inner surface of the inner tub 3. The outer ridge 51 may be spaced apart from the inner ridge 41. As shown, a plurality of outer ridges 51 may be spaced apart from one another in a circumferential direction of the outer pulsator 5. Each outer ridge 51 may be configured to extend by a long length in the circumferential direction of the outer pulsator 5. The outer ridge 51 may have the inner end surface 52 facing the center axis of the outer pulsator 5 and an outer end surface 53 facing the inner surface of the inner tub 3. In an exemplary configuration of the outer ridge 51, the size of the outer end surface 53 is greater than the size of the inner end surface 52. The outer ridge 51 may have a flat upper end. The number of the outer ridges 51 may be equal to the number of the inner ridges 41. The inner ridges 41 of the inner pulsator 4 may be positioned to face the respective outer ridges 51 of the outer pulsator 5 in a radial direction of the inner tub 3. With this configuration, when at least one of the inner pulsator 4 and the outer pulsator 5 is rotated, the inner ridges 41 may be iteratively positioned to alternately face the outer ridges 51 and gaps between the plurality of outer ridges 51. As exemplarily shown in FIG. 3A, a ring-shaped rib 54 may protrude from the outer pulsator 5 to surround the rim of the inner pulsator 4. The ring-shaped rib 54 may serve to protect the rim of the inner pulsator 4 and to prevent fabrics from being jammed in a gap between the inner pulsator 4 and the outer pulsator 5. That is, the ring-shaped rib 54 may function as a fabric jam protector.

The planetary gear device 6 may allow the inner pulsator 4 and the outer pulsator 5 to rotate together, and more particularly, allow the inner pulsator 4 and the outer pulsator 5 to rotate at different rates of rotation. The planetary gear device 6 may be connected to the rotating shaft 23 such that the inner pulsator 4 and the outer pulsator 5 may be rotated at different rates of rotation upon rotation of the rotating shaft 23. The planetary gear device 6 may cause the inner pulsator 4 and the outer pulsator 5 to rotate in opposite directions. That is, the planetary gear device 6 may cause the outer pulsator 5 to more slowly rotate than the inner pulsator 4 in a direction opposite to the rotational direction of the inner pulsator 4.

Figure 3:
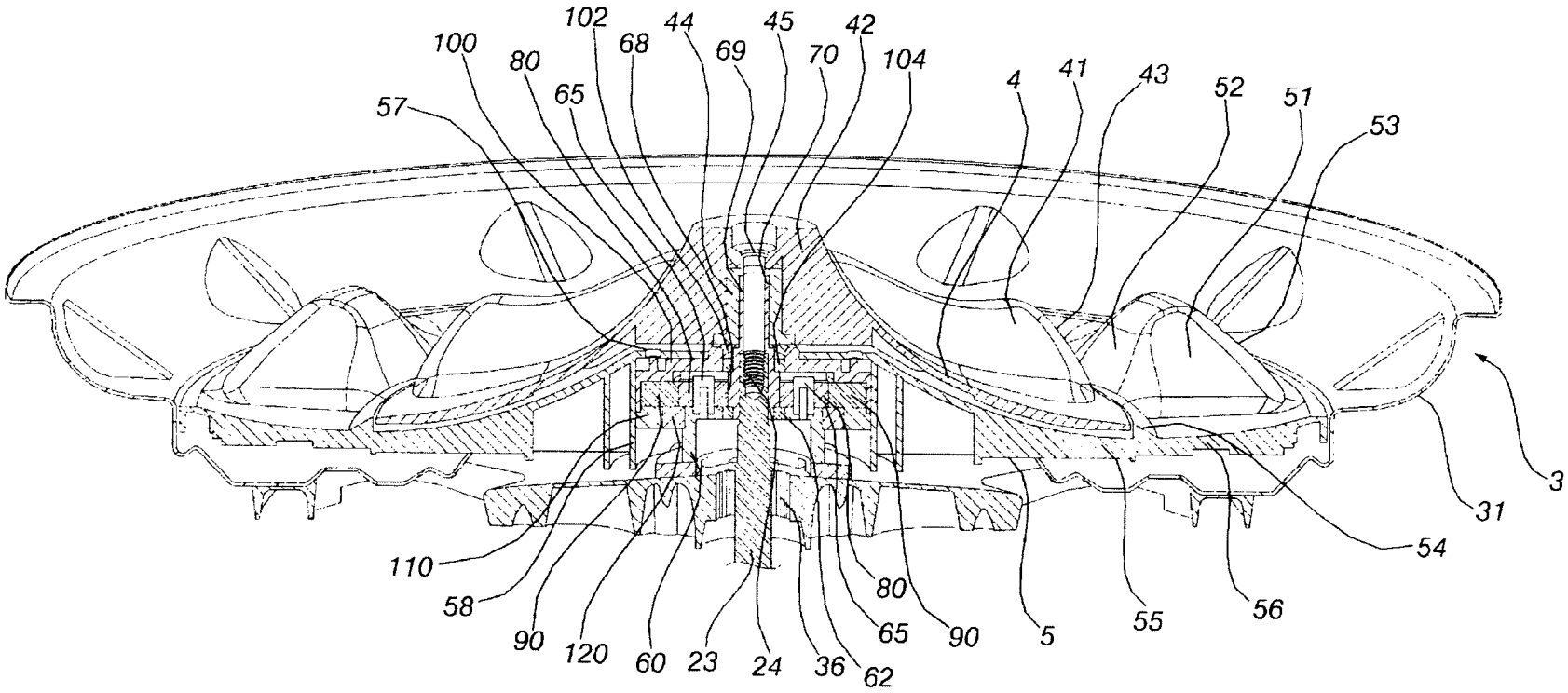
FIG. 3 is a partial cut-away view of a washing machine according to an embodiment of the present invention.
Figure 4:
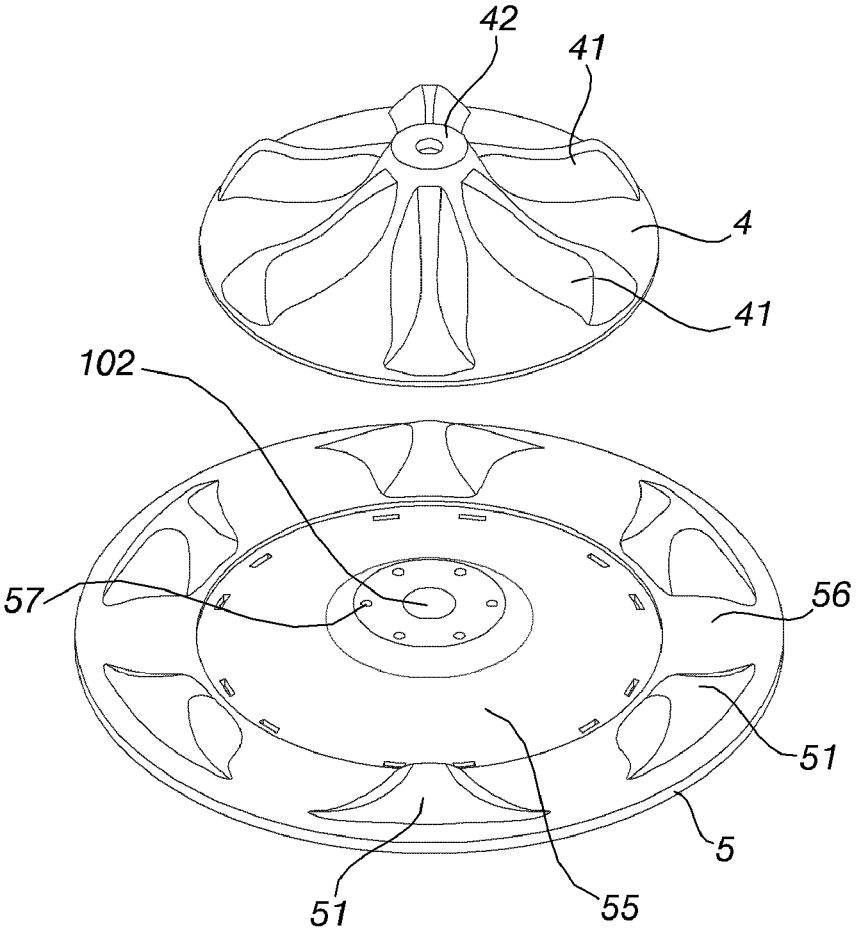
FIG. 4 is a perspective view showing an inner pulsator and an outer pulsator of a washing machine according to an embodiment of the present invention, which are separated from a planetary gear device.
Figure 5:
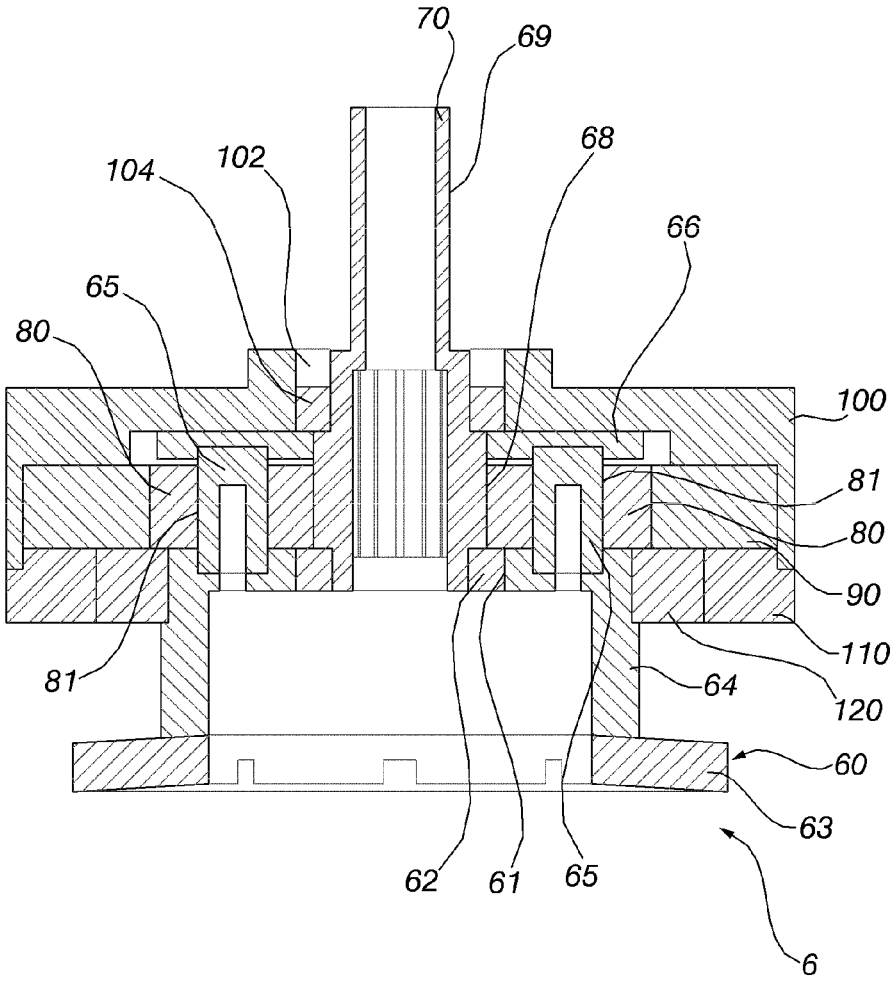
FIG. 5 is an enlarged sectional view of a planetary gear device of a washing machine according to an embodiment of the present invention.
Figure 6:
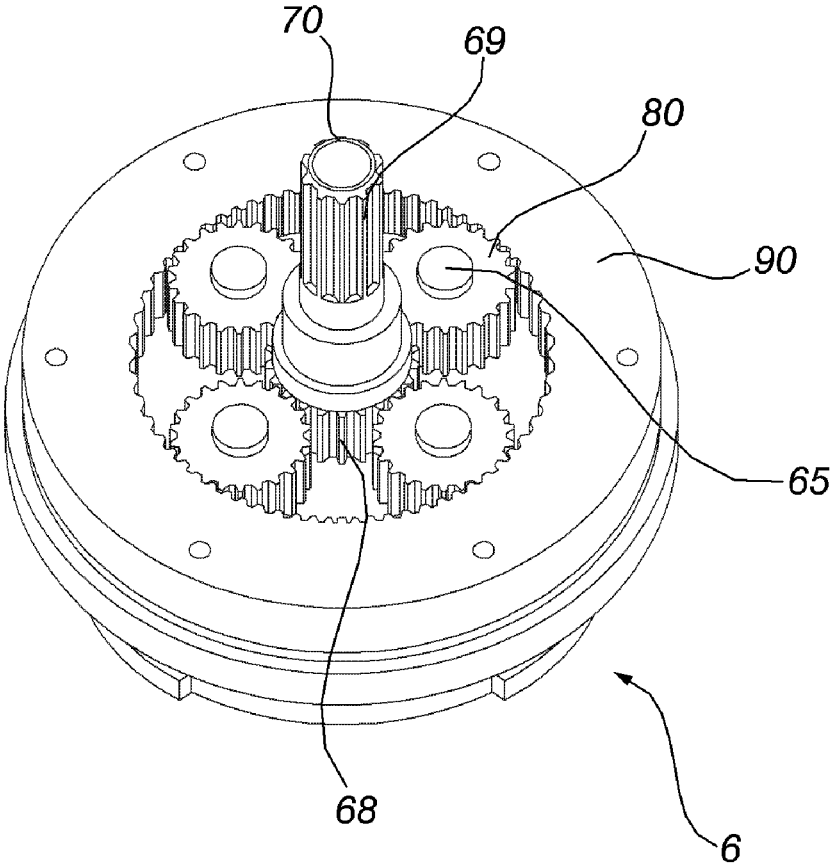
FIG. 6 is a perspective view showing the interior of a planetary gear device of a washing machine according to an embodiment of the present invention.

FIG. 3 is a partial cut-away view of a washing machine according to an embodiment of the present invention, FIG. 4 is a perspective view showing an inner pulsator and an outer pulsator of a washing machine according to an embodiment of the present invention, which are separated from a planetary gear device, FIG. 5 is an enlarged sectional view of a planetary gear device according to an embodiment of the present invention, and FIG. 6 is a perspective view showing the interior of a planetary gear device of a washing machine according to an embodiment of the present invention.

The planetary gear device 6 may include a fixing hub 60 installed to the inner tub 3, a sun gear 70 coupled to the rotating shaft 23, the sun gear 70 consisting of a lower gear portion 68 and an upper pulsator coupling portion 69, a plurality of planetary gears 80 engaged with the gear portion 68, the planetary gears 80 being rotatably arranged on the fixing hub 60, a ring gear 90, an inner circumferential surface of which is engaged with the plurality of planetary gears 80, and a gear box 100 engaged with the ring gear 90.

The fixing hub 60 may be installed on an upper surface of a bottom plate of the inner tub 3. More specifically, the fixing hub 60 may be placed on an upper surface of the inner tub base 31 constituting the bottom plate of the inner tub 3. The inner tub base 31 may be centrally indented to form a recess, and the fixing hub 60 may be seated in the recess. Then, the fixing hub 60 may be fastened to the inner tub base 31 using a fastening member, such as a screw or the like. The fixing hub 60 may have a sun gear through-hole (a lower sun gear through-hole) 61 through which the sun gear 70 penetrates. A lower bearing 62 may be installed in the sun gear through-hole 61 to assist the sun gear 70 in being rotatably supported by the fixing hub 60. The fixing hub 60 may consist of a disc 63 having a center aperture through which the rotating shaft 23 penetrates, and a hub 64 placed on an upper surface of the disc 63, the sun gear through-hole 61 being formed in the hub 64. In turn, the hub 64 may consist of a hollow cylindrical portion and a disc portion at the top of the hollow cylindrical portion, and the sun gear through-hole 61 may be formed in the disc portion. The fixing hub 60 may be provided with support shafts 65 to rotatably support the planetary gears 80. Each support shaft 65 may support the planetary gear 80 to allow the planetary gear 80 to be rotated in place about the support shaft 65 without movement along a circular track around the sun gear 70. The support shaft 65 may be fastened to the fixing hub 60 using a fastening member, such as a pin, screw or the like. The planetary gear device 6 may further include a planetary gear holder 66 coupled to upper ends of the support shafts 65.

The sun gear 70 may consist of the lower gear portion 68 engaged with the planetary gears 80 and the upper pulsator coupling portion 69.

The planetary gears 80 may be located between the sun gear 70 and the ring gear 90. Upon rotation of the sun gear 70, the planetary gears 80 may be rotated about the respective support shafts 65 between the sun gear 70 and the ring gear 90, thereby rotating the ring gear 90. Each of the planetary gears 80 may have a support shaft through-hole 81 through which the support shaft 65 penetrates. With this configuration, the planetary gears 80 may be rotated about the support shafts 65 between the fixing hub 60 and the planetary gear holder 66. In the planetary gear device 6, an inner circumferential surface of the planetary gear 80 or an outer circumferential surface of the support shaft 65 may be immersed with a lubricant.

The ring gear 90 is an internal gear provided at the inner circumferential surface thereof with a gear portion to be engaged with the planetary gears 80. The ring gear 90 may be rotated in a direction opposite to the rotational direction of the sun gear 70. For example, if the sun gear 70 is rotated in a clockwise direction, the ring gear 90 may be rotated in a counterclockwise direction. If the sun gear 70 is rotated in a counterclockwise direction, the ring gear 90 may be rotated in a clockwise direction. In addition, the rate of rotation of the ring gear 90 may be less than the rate of rotation of the sun gear 70. A difference between the rates of rotation of the inner pulsator 4 and the outer pulsator 5 may be determined according to a gear ratio (1:N) of the sun gear 70 to the ring gear 90 of the planetary gear device 6. Here, N is preferably within a range of 2-3. The outer pulsator 5 may be rotated at a higher speed as the gear ratio (1:N) of the sun gear 70 to the ring gear 90 of the planetary gear device 6 is reduced, and may be rotated at a lower speed as the gear ratio (1:N) of the sun gear 70 to the ring gear 90 increases. If the difference between the rates of rotation of the outer pulsator 5 and the inner pulsator 4 excessively increases, washing performance depending on rotation of the outer pulsator 5 may be deteriorated. Therefore, the gear ratio of the sun gear 70 to the ring gear 90 of the planetary gear device 6 is preferably 1:2.

The gear box 100 may be configured to define the external appearance of the top and the circumference of the planetary gear device 6 and serve to protect the planetary gears 80 and the ring gear 90. The gear box 100 may have a bottom opening. The gear box 100 may be used to transmit rotation force of the ring gear 90 to the outer pulsator 5. That is, the gear box 100 may function as a carrier that transmits rotation force of the planetary gear device 6 to the outer pulsator 5. An upper portion of the gear box 100 may be fastened to the outer pulsator 5, and a peripheral portion of the gear box 100 may surround an outer circumferential surface of the ring gear 90. The gear box 100 may be rotated along with the ring gear 90. The ring gear 90 may be fastened to the gear box 100 using a fastening member, such as a screw or the like. In one alternative configuration, the ring gear 90 may be inserted into the gear box 100 so as to be interference fitted into the gear box 100. In another alternative configuration, the ring gear 90 may be attached to an inner surface of the gear box 100 using adhesive means, such as glue or the like. The gear box 100 may have a sun gear through-hole (an upper sun gear through-hole) 102 through which the sun gear 70 penetrates. An upper bearing 104 may be installed in the sun gear through-hole 102 to assist the sun gear 70 in being rotatably supported by the gear box 100.

The planetary gear device 6 may further include a lower cover 110 coupled to a lower portion of the gear box 100. The lower cover 110 may define the external appearance of the bottom of the planetary gear device 6. The lower cover 110 may function as a ring gear stopper that prevents the ring gear 90 from being unintentionally separated downward from the gear box 100. To this end, the lower cover 110 may be provided at an outer rim portion of an upper surface thereof with a fitting groove into which a lower end of the gear box 100 is fitted. Alternatively, an upper end of the lower cover 110 may be partially inserted into the gear box 100. The planetary gear device 6 may further include an outer bearing 120 interposed between the lower cover 110 and the fixing hub 60. The outer bearing 120 may assist the lower cover 110 in being rotatably supported by the fixing hub 60.

The inner pulsator 4 may be coupled to the pulsator coupling portion 69. The inner pulsator 4 may further include a boss 44 installed to the planetary gear device connecting portion 42 such that the pulsator coupling portion 69 is fitted into the boss 44. The inner pulsator 4 may have a screw through-hole 45 formed in the planetary gear device connecting portion 42. Accordingly, a screw may penetrate the through-hole 45 and the boss 44 to thereby be screwed to at least one of the sun gear 70 and the rotating shaft 23.

The outer pulsator 5 may be coupled to the gear box 100. The rate of rotation of the outer pulsator 5 may be less than the rate of rotation of the inner pulsator 4. In addition, the outer pulsator 5 and the inner pulsator 4 may be rotated in opposite directions. The outer pulsator 5 may include a sun gear penetrating portion 55 that faces a lower surface of the inner pulsator 4, through which the sun gear 70 penetrates, and a water stream generating portion 56 from which the at least one outer ridge 51 protrudes upward. The sun gear penetrating portion 55 may be centrally provided with a hub portion 58 having a bottom opening. In addition, the outer pulsator 5 may have a screw through-hole 57 formed in the sun gear penetrating portion 55, through which a screw penetrates to secure the gear box 100 to the outer pulsator 5.

At least a portion of the planetary gear device 6 may be inserted into the hub portion 58 and be protected by the hub portion 58. The gear box 100 may be inserted into the hub portion 58 and be fastened to the sun gear penetrating portion 55 using a fastening member, such as a screw or the like.

An upper portion of the rotating shaft 23 may be located within the planetary gear device 6. The rotating shaft 23 may penetrate the inner tub 3 and the fixing hub 60 of the planetary gear device 6. More specifically, the rotating shaft 23 may penetrate a rotating shaft through-hole 36 formed in the inner tub 3. Then, both the rotating shaft 23 and the sun gear 70 may penetrate the sun gear through-hole 61 formed in the fixing hub 60. To this end, the upper portion of the rotating shaft 23 may be inserted into the sun gear 70 to thereby be fitted into the sun gear 70. The upper portion of the rotating shaft 23 may be provided with a female threaded portion 24 to be engaged with a male threaded portion of a screw that penetrates the inner pulsator 4.

Hereinafter, operation of the washing machine having the above described configuration will be described.

First, the motor 22 may be driven during a washing process of the washing machine. The rotating shaft 23 is rotated via driving of the motor 22, and the sun gear 70 is concurrently rotated along with the rotating shaft 23. Upon rotation of the sun gear 70, the inner pulsator 4 is rotated along with the sun gear 70 in the same direction as the rotational direction of the sun gear 70. The planetary gears 80 between the sun gear 70 and the ring gear 90 may be rotated by the sun gear 70. In addition, the planetary gears 80 are rotated about the respective support shafts 65 that are secured to the fixing hub 60 between the fixing hub 60 and the planetary gear holder 66. In this case, the planetary gears 80 are rotated in place about the support shafts 65 without movement along a circular track around the sun gear 70. The rate of rotation of the ring gear 90 is less than the rate of rotation of the sun gear 70, and the ring gear 90 and the sun gear 70 are rotated in opposite directions. Upon rotation of the ring gear 90, the gear box 100 is concurrently rotated along with the ring gear 90, and the outer pulsator 5 is rotated along with the gear box 100.

In the washing machine according to the present invention, the inner pulsator 4 and the outer pulsator 5 are rotated at different rates of rotation in opposite directions, which may create a more 3-dimensional rotating water stream than the case in which a single pulsator is rotated within the inner tub 3. That is, in the center of the inner tub 3, wash water is primarily moved by the inner pulsator 4, creating a rotating water stream. On the other hand, wash water proximate to the inner surface of the inner tub 3 is moved by the outer pulsator 5, creating a rotating water stream in a direction opposite to that of the wash water in the center of the inner tub 3. In this way, two rotating water streams having different rotational directions and different rates of rotation may be created within the inner tub 3, which results in creation of a more complex 3D water stream than the case in which a single pulsator is installed within the inner tub 3.

As is apparent from the above description, according to the present invention, as a result of rotating an inner pulsator and an outer pulsator at different rates of rotation, a more complex 3D rotating water stream may be created within an inner tub, which may result in enhanced washing ability.

Further, as the inner pulsator and the outer pulsator create rotating water streams in opposite directions, it is possible to allow fabrics accommodated in the inner tub to be washed via rubbing effects, which may enhance washing performance of the washing machine.

Furthermore, a difference between flow rates of water streams within the inner tub may allow fabrics to circulate between an inner center region of the inner tub and a region proximate to an inner surface of the inner tub. This may advantageously ensure washing of fabrics while minimizing tangling thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine with a pulsator and a planetary gear device, the washing machine comprising:

an inner tub in which fabrics are accommodated;

a fixing hub installed to the inner tub;

a rotating shaft configured to penetrate the inner tub and the fixing hub;

a sun gear installed to the rotating shaft, the sun gear having a lower gear portion and an upper pulsator coupling portion;

an inner pulsator coupled to the pulsator coupling portion of the sun gear;

a plurality of planetary gears engaged with the lower gear portion;

a ring gear, an inner circumferential surface of which is engaged with the plurality of planetary gears;

a gear box coupled to the ring gear; and an outer pulsator coupled to the gear box, the size of the outer pulsator is greater than the size of the inner pulsator, wherein a ring-shaped rib protrudes from the outer pulsator to surround a rim of the inner pulsator, wherein the inner pulsator includes a plurality of upwardly protruding inner ridges, wherein the outer pulsator includes a sun gear penetrating portion facing a lower surface of the inner pulsator, through which the sun gear penetrates, and a water stream generating portion from which a plurality of outer ridges protrudes upward, wherein the ring-shaped rib is disposed between the sun gear penetrating portion and the water stream generating portion, the number of the outer ridges is equal to the number of the inner ridges, the inner ridges extend by a long length in a radial direction of the inner pulsator, and wherein the outer ridges extend by a long length in a circumferential direction of the outer pulsator, and the inner ridges have an outer end surface oriented to face the outer ridges of the outer pulsator.

2. The washing machine according to claim 1, wherein the rate of rotation of the outer pulsator is less than the rate of rotation of the inner pulsator.

3. The washing machine according to claim 1, wherein a support shaft configured to rotatably support a corresponding one of the planetary gears is installed to the fixing hub.

4. The washing machine according to claim 3, further comprising:

a planetary gear holder coupled to an upper portion of the support shaft.

5. The washing machine according to claim 3, wherein an inner circumferential surface of the planetary gear and an outer circumferential surface of the support shaft are immersed with a lubricant.

6. The washing machine according to claim 1, wherein the gear box has a sun gear through-hole, through which the sun gear penetrates, and wherein an upper bearing is located in the sun gear through-hole to assist the sun gear in being rotatably supported by the gear box.

7. The washing machine according to claim 1, wherein the fixing hub has a sun gear through-hole, through which the sun gear penetrates, and wherein a lower bearing is located in the sun gear through-hole to assist the sun gear in being rotatably supported by the fixing hub.

8. The washing machine according to claim 1, further comprising:

a lower cover coupled to a lower portion of the gear box.

9. The washing machine according to claim 8, further comprising:

an outer bearing located between the lower cover and the fixing hub to assist the lower cover in being rotatably supported by the fixing hub.

10. The washing machine according to claim 1, wherein the sun gear penetrating portion is centrally provided with a hub portion having a bottom opening, and wherein the gear box is inserted into the hub portion to thereby be coupled to the outer pulsator.

11. The washing machine according to claim 1, wherein the outer ridges are spaced apart from the inner ridges.

12. The washing machine according to claim 1, wherein the fixing hub is installed on an upper surface of a bottom plate of the inner tub.

* * * * *